US009546488B2

(12) United States Patent
Long

(10) Patent No.: US 9,546,488 B2
(45) Date of Patent: Jan. 17, 2017

(54) SPEED STRIKER MULTI-FUNCTION MASONRY TOOL

(71) Applicant: Michael L. Long, Gardnerville, NV (US)

(72) Inventor: Michael L. Long, Gardnerville, NV (US)

( * ) Notice: Subject to any disclaimer, the term of this patent is extended or adjusted under 35 U.S.C. 154(b) by 0 days.

(21) Appl. No.: 14/738,510

(22) Filed: Jun. 12, 2015

(65) Prior Publication Data

US 2016/0194886 A1 Jul. 7, 2016

Related U.S. Application Data

(63) Continuation-in-part of application No. 14/544,417, filed on Jan. 5, 2015, now abandoned.

(51) Int. Cl.

| | |
|---|---|
| ***A47L 13/12*** | (2006.01) |
| ***B28D 1/26*** | (2006.01) |
| ***E04F 21/165*** | (2006.01) |
| ***B28D 1/00*** | (2006.01) |

(52) U.S. Cl.

CPC ..... *E04F 21/165* (2013.01); *A47L 13/12* (2013.01); *B28D 1/001* (2013.01); *B28D 1/26* (2013.01); *E04F 21/1652* (2013.01)

(58) Field of Classification Search

CPC ..... A47L 13/12; E04F 21/0084; E04F 21/165; B28D 1/26

See application file for complete search history.

(56) References Cited

U.S. PATENT DOCUMENTS

| | | | | | |
|---|---|---|---|---|---|
| 1,396,629 | A * | 11/1921 | Hand | B67B 7/44 | 220/278 |
| 1,408,677 | A * | 3/1922 | Zorn | F25C 5/043 | 30/164.7 |
| 1,461,152 | A * | 7/1923 | Keeler | F25C 5/043 | 30/164.6 |
| 1,793,378 | A * | 2/1931 | Smith | A01B 1/022 | 30/164.6 |
| 1,863,801 | A * | 6/1932 | Lorber | B67B 7/44 | 29/275 |
| 1,923,986 | A * | 8/1933 | Lorber | F25C 5/043 | 30/164.6 |
| 2,466,845 | A * | 4/1949 | Ghee | B25B 27/0028 | 173/91 |
| 3,031,704 | A * | 5/1962 | Farchmin | E04F 21/0084 | 15/105.5 |
| 3,175,291 | A * | 3/1965 | Nardo | B26B 13/20 | 30/254 |
| 4,287,631 | A * | 9/1981 | Marrs | A46B 17/06 | 15/104.001 |
| 2004/0250364 | A1* | 12/2004 | Kairys | E04F 21/0084 | 15/105.5 |

* cited by examiner

*Primary Examiner* — Randall Chin
(74) *Attorney, Agent, or Firm* — Howard Cohen

(57) ABSTRACT

A multifunction masonry tool includes a handle adapted to be held firmly in the grip of one hand. The handle is a polygonal solid, with for example four sides arrayed in generally rectangular or square cross-sectional arrangement. A narrow neck is disposed adjacent to a first end of the handle to enhance the grip of the thumb and forefinger. A loop extends from one end of the handle and a pick extends from the opposed end, both formed of a hardened, form-retaining rod material. The pick and loop may be formed from a single piece of the rod material that extends axially through the handle.

9 Claims, 2 Drawing Sheets

SPEED STRIKER MULTI-FUNCTION MASONRY TOOL

CROSS-REFERENCE TO RELATED APPLICATIONS

This application claims the benefit of the filing date priority of U.S. application Ser. No. 14/544,417, filed Jan. 5, 2015, now abandoned.

FEDERALLY SPONSORED RESEARCH

Not applicable.

SEQUENCE LISTING, ETC ON CD

Not applicable.

BACKGROUND OF THE INVENTION

Field of the Invention

This invention relates to a masonry tool and, more particularly, to a masonry hand tool that provides distinct structural elements at opposed ends to achieve differing masonry functions.

Description of Related Art

A skilled mason requires an extensive tool kit to undertake all of the tasks that are encompassed in masonry, beyond the well known tasks of laying brick and stone to make functional structures. It is also necessary, e.g., to build hardscape, repair existing masonry structures, apply and repair stucco, and the like. Often these jobs involve switching frequently between various tasks and switch tools. Thus many tools must be available and close-at-hand, which can complicate a work site. Clearly any tool innovation that combines the function of more than one tool into a single implement is a welcome advance in the field.

BRIEF SUMMARY OF THE INVENTION

The present invention generally comprises a multifunction masonry tool that combines two desirable masonry tool components into a single hand implement.

The implement includes a handle dimensioned and adapted to be held firmly in the grip of one hand. The handle includes an outer surface defining a four-sided polygonal solid extending along an axis, with the four sides arrayed in generally rectangular or square cross-sectional arrangement. The four sides are curved slightly to define a narrower neck disposed adjacent to a first end of the handle, and tapered distally to define a narrower second, axially-opposed end of the handle. The neck is provided to enhance the grip of the thumb and forefinger of the gripping hand, while the fingers wrap around the medial and distal portions of the handle to exert a firm grip.

Extending from the first end of the handle is a loop formed of a hardened, form-retaining rod material, such as 3/16 inch steel rod. Extending from the second end is a pick extending generally axially. The pick and loop may be formed from a single piece of the rod material that extends axially through the handle. The pick end may include an axial portion adjacent to the distal end of the handle, and an oblique portion extending contiguously therefrom, and terminating in a sharpened point.

The implement is designed to facilitate and ease the tasks involved in cutting mortar and similar materials, particularly on rock and stucco stone jobs. The handle may be fully gripped in one hand to swing the tool and use the pick to strike, break, and pick various materials. Alternatively, the handle may be held by partially wrapping the hand about the handle with the thumb and forefinger pinching opposed sides of the proximal neck, so that the loop end may be wielded deftly to remove excess mortar from mortar and stucco joints and form or repair mortar joints.

DETAILED DESCRIPTION OF THE INVENTION

The present invention generally comprises a masonry tool that combines two desirable masonry tool components into a single hand implement.

With regard to FIGS. 1-4, the implement 11 of the invention includes a handle 12 having a configuration for being held firmly in the grip of one hand. In the preferred embodiment, the handle is provided with an outer surface having a four-sided polygonal arrangement that extends along an axis. The handle may be provided with fewer or greater number of sides, and has an average handle circumference of approximately 4½ inches long or the like that enables a full grip by one hand. The sides are generally identical and contiguous, with smoothly curved transitions between the sides where they intersect.

Figure 1:
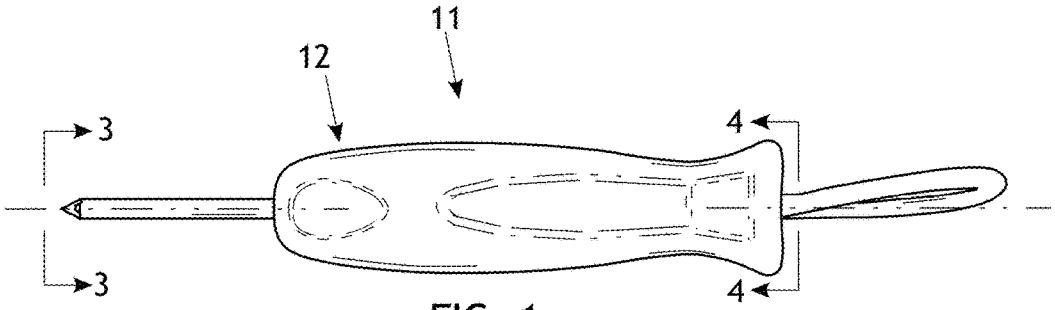
FIGS. 1 and 2 are isometric top and side views of the implement of the present invention.
Figure 2:
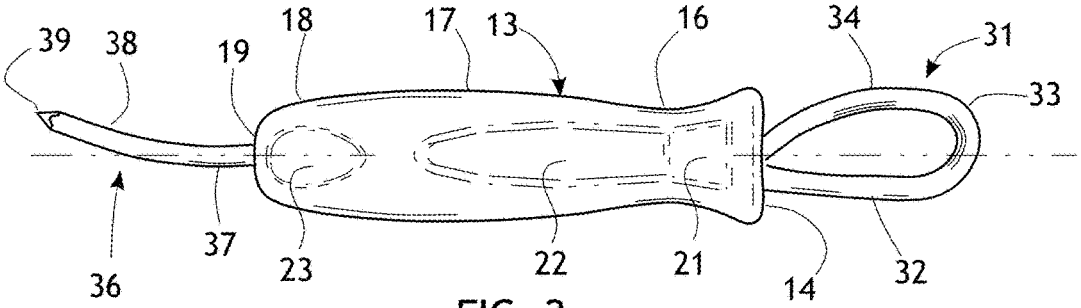
Figure 3:
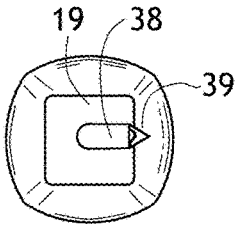
FIGS. 3 and 4 are end views of the implement of FIGS. 1-2, taken along lines 3-3 and 4-4, respectively.
Figure 4:
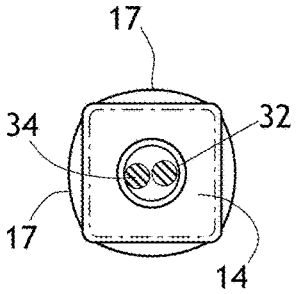
Figure 5:
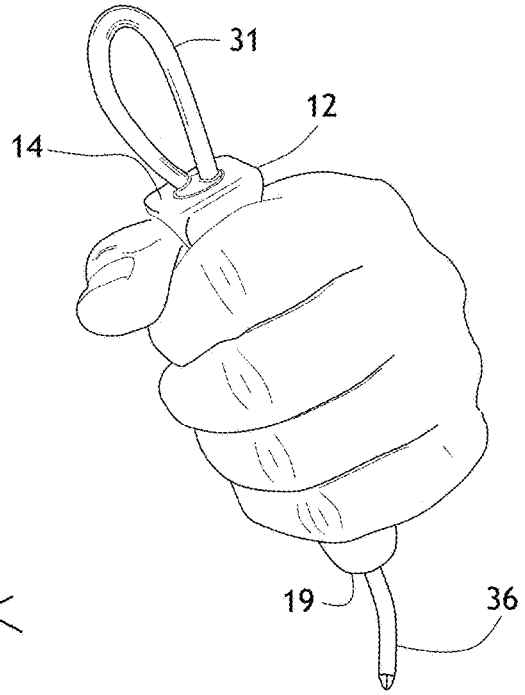
FIG. 5 is a perspective view of the tool of the invention in the grip of a hand.

The four sides 13 may be arranged in a generally rectangular or square cross-sectional configuration, as shown in FIGS. 3 and 4. At the proximal or first end of the handle 12, the sides converge at a rectangular end surface 14 that is planar and transverse to the axis. Adjacent to the end surface 14, the sides 13 converge toward the axis and taper inwardly to define a neck 16 that is provided to accommodate the grip of the thumb and forefinger of the gripping hand, as shown in FIG. 5. From the neck 16 toward the medial portion 17 of the handle the sides 13 diverge outwardly slightly from the axis to form an enlarged mid-section of the handle. At the distal end of the handle, the sides (18) taper slightly toward the axis and join the distal end 19, all conjunctions having smoothly curved transitions.

For ease of manufacturing, the sides 13 may all be formed in a similar manner. In the preferred embodiment, there is a proximal shallow depression 21 formed and blended in the surface between the end 14 and neck 16, and a medial shallow depression 22 likewise formed and extending parallel to the axis in medial portion 17. A distal shallow depression 23 is formed and blended in the surface of each side 13 adjacent to the distal end 19. All of the shallow depressions 21-23 provide greater purchase for the curved surfaces of the fingers and thumb of the user of the tool.

Extending from the first, proximal end of the handle 12 is a loop 31 formed of a hardened, form-retaining rod material, such as 3/16 inch steel rod. The loop 31 is comprised of a generally linear portion 32 of the rod extending generally parallel to the axis of the tool. The opposite side 34 of the loop 31 is joined to the segment 32 by a proximal curved segment 33 having a small radius of curvature, all of the loop sections extending continuously and smoothly in their conjunctions with each other.

Extending from the second, distal end of the handle 12 is a pick 36 generally aligned with the tool axis. The pick 31 includes a portion 37 adjacent to the handle end 19 that is generally coaxial with the tool, and a distal portion 38 that is bent from the axis in the range of 10°-20°. The distal end 39 is sharpened and hardened, as by heat treating, case hardening, and the like. The pick is adapted to perform tasks typical of other pick tools, such as prying apart objects, picking apart objects, and striking and breaking surfaces and materials.

The pick 36 is also formed of the same 3/16 inch steel rod material of the loop 31. Indeed, the tool 11 may be manufactured by inserting a suitable length of rod material through a central bore in the handle 12, forming the loop in the proximal end, and securing the rod in the handle by adhesive, internal detents, or the like. The handle may be molded of polymer or resin plastic materials, or machined or cast, or 3D printed using state of the art additive manufacturing machines.

In the preferred embodiment the tool incorporates approximately 12 inches of steel rod material, and the loop 31 is approximately 2 inches in axial length and ¾ inch to one inch in maximum width. The handle 12 is approximately 4¼ inches to 4½ inches long. These dimensions are suggested parameters and are subject to modification to accommodate changing materials and formats in masonry.

Figure 6:
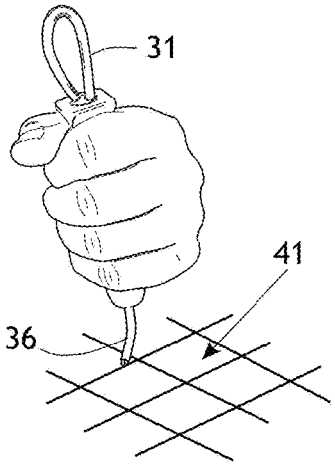
FIG. 6 is a perspective view of the tool of the invention, shown with the pick end in use.

With reference to FIGS. 5 and 6, the handle 12 is designed to be gripped by one hand, with the fingers wrapped completely about the circumference of the handle, and thumb and forefinger wrapped about the neck 16 and the thumb overlapping the forefinger. The fingers of the hand are generally transverse to the axis of the tool in this grip. This enables a very firm grip, and is particularly useful for swinging the tool forcefully and using the pick 36 to strike, break, and pry materials 41, as suggested in FIG. 6.

Figure 7:
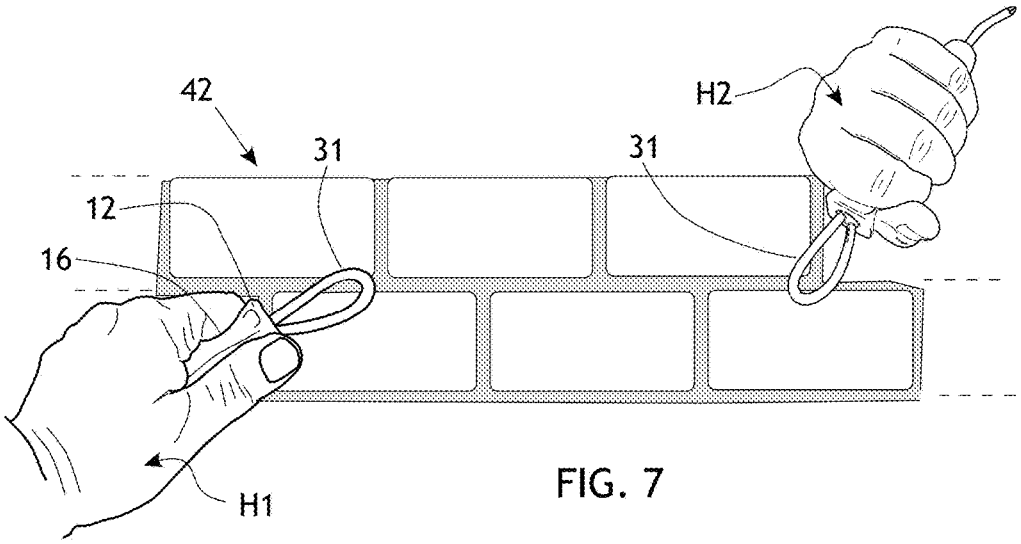
FIG. 7 is a perspective view of the tool of the invention, shown with the loop end in use.

In addition, the handle is designed to be wielded alternatively as shown in FIG. 7 (reference numeral H1), in which the thumb and forefinger of the hand are disposed to pinch the neck 16 at opposed sides thereof, and the fingers are oblique to the axis of the tool. In this grip the loop 31 may be wielded with greater dexterity and range of motion. The loop 31 may be used to cut excess mortar from a lay-up 42, as suggested in FIG. 7, and to smooth joints between blocks, stones, or stucco surfaces. The linear loop section 32 provides a linear swipe along a surface to cut and smooth mortar with a smooth flat stroke, while the curved sections 33 and 34 enable the formation of concave mortar joints. Of course, the loop may be wielded using the fully wrapped hand grip (H2), as also shown in FIG. 7, if and when the task demands it.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A multifunction masonry tool, including:

a handle extending along an axis and adapted to be gripped by one hand of a user;

a rod extending axially through said handle and fixedly secured therein;

a first tool component including a loop integrally formed by said rod and extending generally parallel to said axis and protruding from a proximal end of said handle;

a second tool component including a pick integrally formed by said rod and extending generally parallel to said axis and protruding from a distal end of said handle;

said handle comprising a polygonal solid having a longitudinal extent along said axis and including a neck portion adjacent to said proximal end;

said polygonal solid including a peripheral circumference sufficient to enable a first hand grasp in which the fingers are wrapped entirely about the circumference with the thumb overlapping the forefinger at said neck portion of the handle, and a second hand grasp in which the thumb and forefinger pinch opposed sides of said neck portion of said handle, and the fingers are wrapped partially about said handle, whereby said loop may be wielded with greater dexterity.

2. The multifunction masonry tool of claim 1, wherein said pick includes a first portion extending coaxially from said distal end of said handle.

3. The multifunction masonry tool of claim 2, wherein said pick includes a second portion extending from said first portion and disposed obliquely to said axis.

4. The multifunction masonry tool of claim 3, further including a sharpened hardened tip at the distal end of said second portion.

5. The multifunction masonry tool of claim 1, wherein said loop includes a first portion extending coaxially and linearly from said proximal end of said handle.

6. The multifunction masonry tool of claim 5, wherein said loop includes a second, gently curved portion extending proximally from said handle, and a third, highly curved end portion joining the proximal ends of said first and second loop portions in a continuous, smoothly transitioned integral fashion.

7. The multifunction masonry tool of claim 6, wherein said loops is approximately 2 inches in axial length and less than one inch in maximum width.

8. The multifunction masonry tool of claim 7, wherein said handle is approximately 4⅜ inches long, with an average circumference of about 4½ inches.

9. The multifunction masonry tool of claim 8, wherein said pick is about 2 inches long.

* * * * *